US010265841B2

(12) United States Patent
Rauwerdink et al.

(10) Patent No.: US 10,265,841 B2
(45) Date of Patent: Apr. 23, 2019

(54) MULTI-FUNCTION TOOL

(71) Applicant: Fiskars Brands, Inc., Madison, WI (US)

(72) Inventors: Matt Rauwerdink, Portland, OR (US); Hal Hardinge, Tigard, OR (US); Benjamin J. Nyssen, Tigard, OR (US); Jason Keenan, Lake Oswego, OR (US)

(73) Assignee: Fiskars Brands, Inc., Middleton, WI (US)

( * ) Notice: Subject to any disclaimer, the term of this patent is extended or adjusted under 35 U.S.C. 154(b) by 408 days.

(21) Appl. No.: 15/084,241

(22) Filed: Mar. 29, 2016

(65) Prior Publication Data

US 2016/0288309 A1 Oct. 6, 2016

Related U.S. Application Data

(60) Provisional application No. 62/141,728, filed on Apr. 1, 2015.

(51) Int. Cl.

| | |
|---|---|
| ***B25F 1/00*** | (2006.01) |
| ***B25F 1/04*** | (2006.01) |
| ***B25B 15/00*** | (2006.01) |
| ***B26B 11/00*** | (2006.01) |

(52) U.S. Cl.

CPC ..... *B25F 1/003* (2013.01); *B25B 15/00* (2013.01); *B25F 1/04* (2013.01); *B26B 11/001* (2013.01); *B26B 11/003* (2013.01)

(58) Field of Classification Search

CPC ..... B25F 1/003; B25F 1/04; B26B 11/001; B26B 11/003; B25G 3/38; B25B 15/00

See application file for complete search history.

(56) References Cited

U.S. PATENT DOCUMENTS 5,142,721 A * 9/1992 Sessions ..... B25B 7/22 30/123
5,212,844 A * 5/1993 Sessions ..... B25B 7/22 30/162
6,523,203 B2 * 2/2003 Harrison ..... B25F 1/003 7/128

(Continued)

FOREIGN PATENT DOCUMENTS

DE 20 2008 013 012 U1 12/2008
EP 1 557 242 A1 7/2005

(Continued)

OTHER PUBLICATIONS

International Search Report and Written Opinion, PCT/US2016/024785, Fiskars Brands, Inc., 12 pages (dated Jul. 6, 2016).

(Continued)

*Primary Examiner* — David B. Thomas
(74) *Attorney, Agent, or Firm* — Foley & Lardner LLP

(57) ABSTRACT

A multifunction tool includes a first handle and a second handle where each of the first and second handles include a non-linear track forming a slot. The multifunction tool further includes a jaw assembly slidably coupled to the non-linear tracks of the first and second handles where the jaw assembly is configured to slide within the slots of the first and second handles between a stowed position within the handles and a deployed position extending from the handles.

20 Claims, 13 Drawing Sheets

(56) References Cited

U.S. PATENT DOCUMENTS

| | | | | |
|---|---|---|---|---|
| 6,721,984 | B1 * | 4/2004 | Harrison | B25F 1/003 7/128 |
| 8,857,299 | B2 * | 10/2014 | Huttula | B25F 1/003 7/128 |
| 9,656,373 | B2 * | 5/2017 | Huttula | B25F 1/003 |
| 2015/0020651 | A1 * | 1/2015 | Wang | B25F 1/003 81/407 |

FOREIGN PATENT DOCUMENTS

| | | | |
|---|---|---|---|
| EP | 2 335 882 | A2 | 6/2011 |
| EP | 2 614 930 | A2 | 7/2013 |
| WO | WO-2004/069489 | A1 | 8/2004 |

OTHER PUBLICATIONS

English-language machine translation of DE 20 2008 013 012, T One R&D Corp. (Dec. 11, 2008).

* cited by examiner

MULTI-FUNCTION TOOL

CROSS-REFERENCE TO RELATED APPLICATIONS

The present application claims the benefit of U.S. Provisional Patent Application No. 62/141,728, filed Apr. 1, 2015, which is incorporated by reference in its entirety.

BACKGROUND

The present application relates generally to the field of multi-function tools. Multi-function tools typically include a pair of handles and an implement such as a wrench, pair of scissors, or pliers, along with a number of ancillary tools used to perform any number of tasks. The ancillary tools are typically pivotally attached to one end of one handle of the multi-function tool. Multi-function tools generally utilize a number of configurations intended to provide a stowed position and a deployed position for the implement and ancillary tools. One such configuration involves attaching each of the handles in a pivotal manner to the implement such that the handles may rotate about the implement to either house the implement between the handles or to position the implement in a ready-to-use orientation. Another such configuration involves slidably attaching the implement to a pair of handles such that the implement may slide between stowed and deployed configurations.

Current multi-function tools having slidably attached implements can have an audible and tactile rattle when shaken regardless of whether the implement is stowed or deployed. The implement may rattle due to small gaps between the handle slots and the sliding implement. Typically, such gaps are required due to normal manufacturing tolerances that require the slots to be larger than the sliding implement.

Current multi-function tools further are difficult to deploy in a smooth, low friction manner due to the implement necessarily having a closed position when initially deployed. Current multi-function tool designs typically hold the implement closed throughout the entire transition from the stowed position to the deployed position by having tight up-down tolerances between the implement and the handles at all times.

Current multi-function tools may further have a driver that typically swings out 180 degrees from a stowed position from a handle to an off-center deployed position relative to both handles. Such an off-center driver can make driving screws awkward and requires a user to continually adjust their grip as they make rotations of the handle.

Current multi-function tools may further have handle profiles that are either U-channel shaped or W-channel shaped when viewed as a cross-section. U-channel shaped handles typically have the advantage of storing components in a compact manner, but require a difficult two-handed action for deployment. W-channel shaped handles typically provide easier one-hand deployment of components, but are less compact in storing the components.

SUMMARY

One embodiment relates to a multifunction tool that includes a first handle, a second handle, and a jaw assembly. Each of the first and second handles include a non-linear track forming a slot. The jaw assembly is slidably coupled to the non-linear tracks of the first and second handles. The jaw assembly is further configured to slide within the slots of the first and second handles between a stowed position within the handles and a deployed position extending from the handles.

Another embodiment relates to a multi-function tool that includes a first handle, a second handle, and a jaw assembly. Each of the first and second handles include an inner surface and an outer surface. The jaw assembly includes a pair of jaws pivotally coupled together, and each of the jaws include a tang having a wedge configured to interface with the inner surface of either the first or second handle to create an interference that pushes the jaws closed tight when the jaw assembly is slid from a stowed position to a deployed position.

Another embodiment of the invention relates to a multi-function tool that includes a first handle, a second handle, a jaw assembly, and a driver. The first handle and the second handle are pivotable between an open position and a closed position. The jaw assembly is slidably coupled to the first and second handles. The jaw assembly is also configured to slide between a stowed position within the handles and a deployed position extending from the handles. The driver is pivotally coupled to the first handle. The driver is also configured to pivot between a stowed position either within or alongside the first handle and a deployed position extending from the first handle. The driver is further configured to have an on-center position when in the deployed position relative to a combined mass of the first and second handles when the handles are in the closed position.

Another embodiment of the invention relates to a multi-function tool that includes a plurality of tools, a first handle, and a second handle. The plurality of tools each have a stowed position and a deployed position. The first handle has a first channel having a first shape configured to compactly store a tool of the plurality of tools and requiring two hands to deploy the stored tool. The second handle has a second channel having a second shape configured to store a tool of the plurality of tools less compactly than the first handle but requiring only one hand to deploy the stored tool.

Another embodiment of the invention relates to a multi-function tool that includes a plurality of tools, a first handle, a second handle, a jaw assembly, and a driver. The plurality of tools each have a stowed position and a deployed position. The first handle has a first channel having a first shape configured to compactly store a tool of the plurality of tools and requiring two hands to deploy the stored tool. The second handle has a second channel having a second shape configured to store a tool of the plurality of tools less compactly than the first handle but requiring only one hand to deploy the stored tool. Each of the first and second handles comprise a non-linear track forming a slot, and wherein each handle comprises an inner surface and an outer surface. The jaw assembly is slidably coupled to the non-linear tracks of the first and second handles. The jaw assembly is also configured to slide within the slots of the first and second handles between a stowed position within the handles and a deployed position extending from the handles. The jaw assembly further includes a pair of jaws pivotally coupled together and each of the jaws includes a tang having a wedge configured to interface with the inner surface of either the first or second handle to create an interference that pushes the jaws closed tight when the jaw assembly is slid from a stowed position to a deployed position. The driver is pivotally coupled to the first handle. The driver is also configured to pivot between a stowed position either within or alongside the first handle and a deployed position extending from the handles. The driver is further configured to have an on-center position relative to a combined mass of the first and second handles when in the deployed position The invention is capable of other embodiments and of being practiced or being carried out in various ways. It is to be understood that the invention is not limited in its application to the details of construction and the arrangements of components set forth in the following description or illustrated in the drawings. Alternative exemplary embodiments relate to other features and combinations of features as may be generally recited in the claims.

DETAILED DESCRIPTION

Figure 1A:
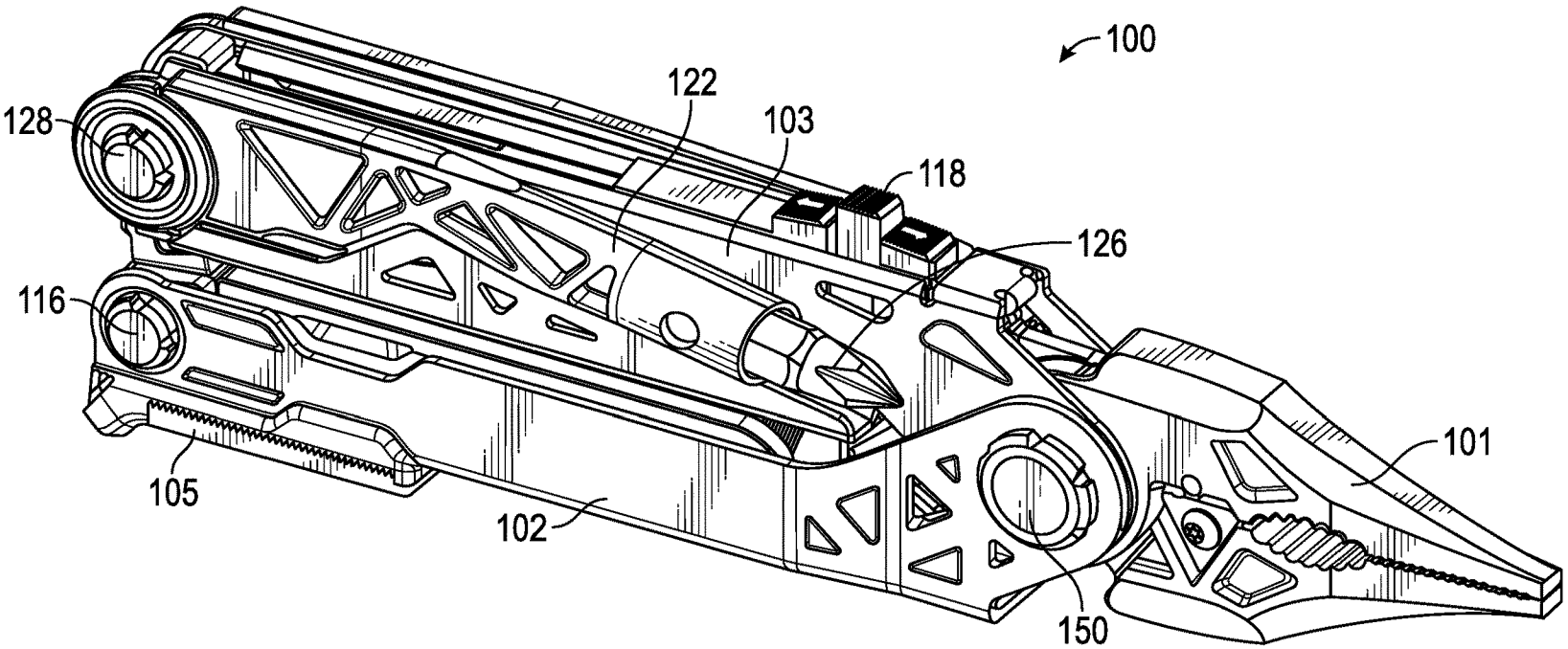
FIG. 1A is a perspective view of a multi-function tool having an implement where the implement is in a deployed configuration according to an exemplary embodiment.
Figure 1B:
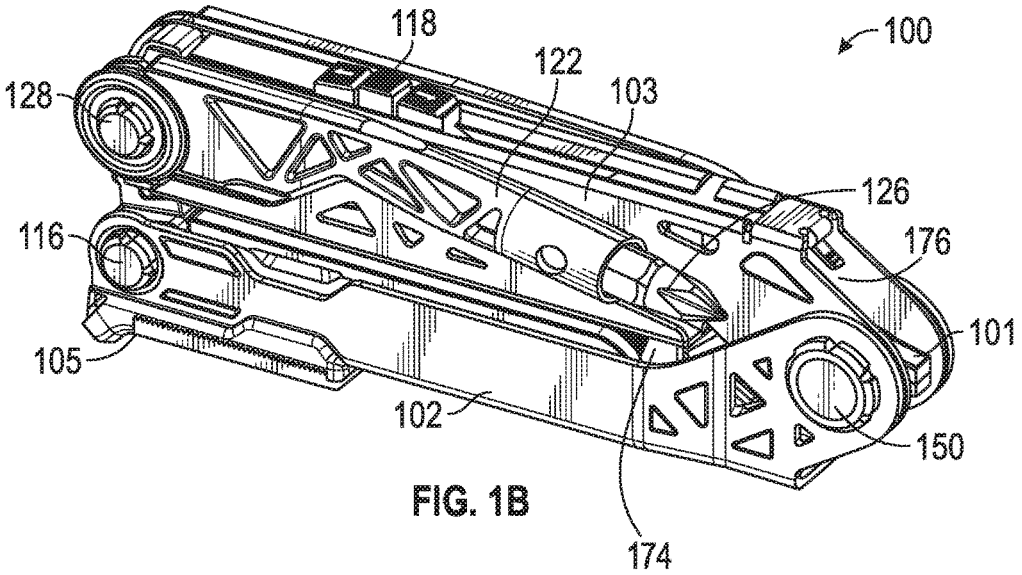
FIG. 1B is a perspective view of the multi-function tool of FIG. 1 where the implement is in a stowed configuration according to an exemplary embodiment.

Referring to FIGS. 1A-1B, a multi-function tool 100 is shown according to an exemplary embodiment. With specific reference to FIG. 1A, a perspective view of multi-function tool 100 is shown as having an implement 101, a first handle 102, a second handle 103, and various ancillary tools, such as blades, screwdrivers, files, bottle openers, can openers, scissors, prybars, awls, and the like. The ancillary tools are shown in FIGS. 1A-1B as being pivotally mounted to the distal ends of handles 102, 103, though the ancillary tools may be coupled to handles 102, 103 by any number of ways known in the art. The handles 102, 103 may be pivotally connected according to any number of ways known in the art. As shown in the accompanying Figures, handles 102, 103 are pivotally connected by handle rivet 150. Implement 101 may be coupled to handles 102, 103 in any number of ways known in the art. For example, as shown in the embodiment depicted in FIGS. 1A-1B, implement 101 is slidably coupled to a slot 174, 176 in each of the handles 102, 103.

According to various embodiments of multi-function tool 100, designs are provided that reduce rattling, including tactile ratting. For example, various embodiments of multi-function tool 100 reduce or eliminate rattling between implement 101 and handles 102, 103. In various embodiments, multi-function tool 100 may have a loose up-down tolerance between implement 101 and handles 102, 103 through a portion of the transition from a stowed to deployed position while still having an implement 101 that is configured to have a closed position when initially deployed. In some embodiments, multi-function tool 100 provides a driver 122 that makes driving screws less awkward than the drivers of traditional multi-function tools. Various embodiments of multi-function tool 100 further provide handles having different channel shapes, thereby providing a user with the benefits of multiple handle designs.

In the embodiments depicted in the Figures, implement 101 is a jaw assembly having a first and second pivotally connected member, each member including a tang disposed rearwardly of the pivotal connection, and a working portion disposed forwardly of the pivotal connection for, for example, gripping or cutting. In some embodiments, the pivotal connection includes a spring 160 biased to open implement 101 when deployed (see FIGS. 6A-6C). It will be appreciated that implement 101 could also be other types of implements such as scissors, a wrench, and so on. Implement 101 may be configured to selectively retract into handles 102, 103 to be stowed and may slide into a fully extended position when deployed. In the extended position, implement 101 is capable of pivotal movement with respect to each jaw in response to divergence and convergence of handles 102, 103. In some embodiment, the handles 102, 103 are prevented from opening when implement 101 is in the stowed position.

In some embodiments, the pivotal connection of implement 101 may be at least slidably disengageable and separate from the pivotal connection of handles 102, 103. Implement 101 may be suitably made of a corrosion resistant material such as stainless steel. The side surfaces and outer exterior top and bottom of implement 101 may be highly polished to facilitate sliding relative to handles 102, 103, and may be of a weight sufficient to facilitate a forward sliding movement and locking of implement 101 in an extended position in response to inertial force without creating excessive stopping inertia. In some embodiments, multi-function tool 100 may include a spring configured deploy implement 101. The spring-loaded implement 101 may be deployed based on pushing a button, moving a lever, and so on. In some embodiments, the button or lever for releasing implement 101 may include a safety mechanism to prevent unintentional deployment of implement 101.

As shown in FIGS. 1A-1B, implement 101 may be slidably coupled to handles 102, 103. In some embodiments, implement 101 is configured to slide within slots 174, 176 of handles 102, 103 between the stowed position within the handles (FIG. 1A) and the deployed position extending from the handles (FIG. 1B). Implement 101 may be slidably coupled to handles 102, 103 using a slip fit at all adjacent surfaces (i.e., top, bottom, and sides) irrespective of the position of implement 101 relative to handles 102, 103 (i.e., stowed, fully deployed, partially deployed). In some embodiments, the slots 174, 176 may have an angled, non-linear guide 178, 180 that functions as a wedge as the implement 101 is slid from the stowed configuration to the deployed position. In some embodiments, the angled, non-linear guide 178, 180 may align the implement within the handles.

Figure 2:
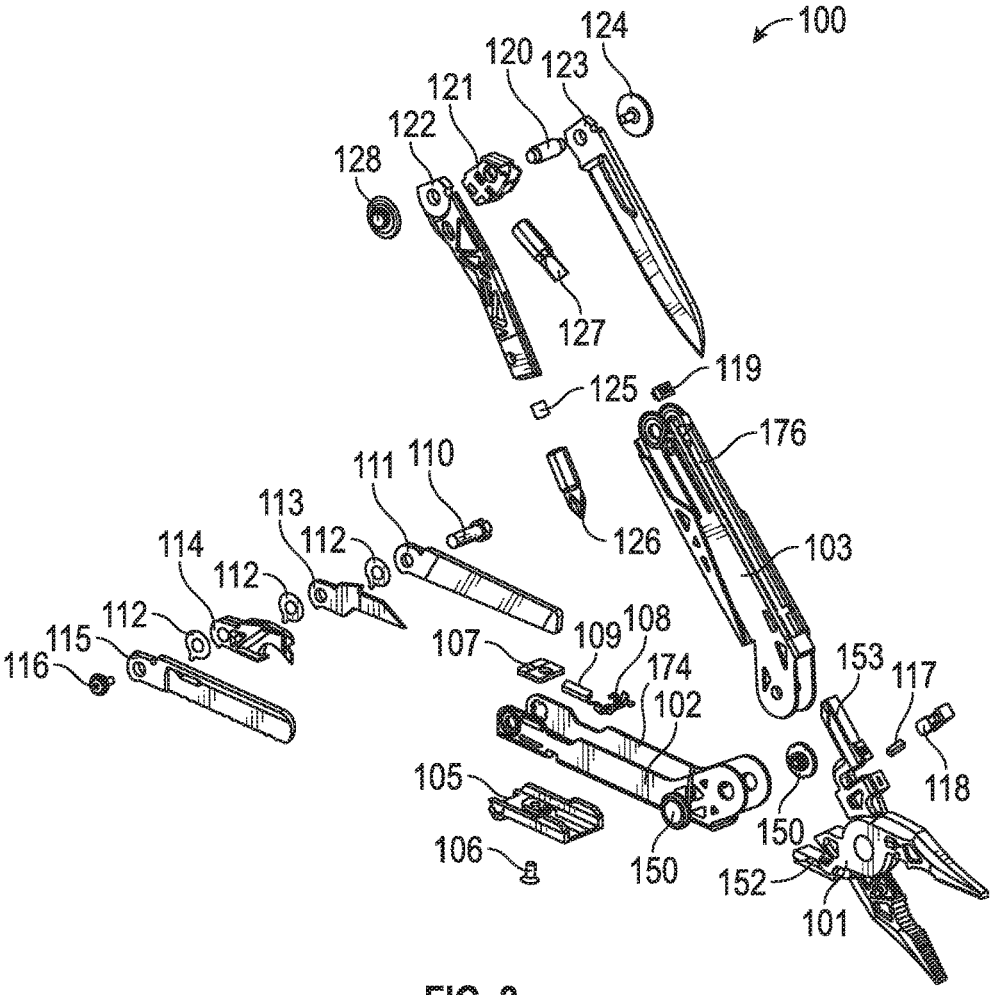
FIG. 2 is an exploded view of the multi-function tool of FIG. 1 according to an exemplary embodiment.

Referring now to FIG. 2, an exploded view of the multi-function tool of FIG. 1 is shown according to an exemplary embodiment. As shown, first handle 102 of multi-function tool 100 may include any number of ancillary tools, including file 111, awl 113, prybar 114, and serrated blade 115. In some embodiments, the ancillary tools may be spaced apart by spacers 112. The ancillary tools may be coupled to first handle 102 by any number of ways known in the art, including rivets, screws, and other fasteners. As shown in FIG. 2, the ancillary tools are pivotally coupled to first handle 102 by an axle assembly having axle 110 and axle screw 116. First handle 102 may further include other components, such as wedge 107, clip 108, and spring 109, to enable ancillary tools or implement 101 to move from a stowed to deployed configuration or to secure ancillary tools or implement 101 in the stowed and deployed configurations. A wedge button 105 configured to disengage locked ancillary tools may be coupled to first handle 102 by any means known in the art, such as rivet 106.

Second handle 103 of multi-function tool 100 may include any number of ancillary tools, including blade 123, bit holder 121, and driver 122. In some embodiments, any number of ancillary tools may be stowed within or alongside second handle 103. In one embodiment, as shown in FIG. 2, driver 122 is configured to be stowed alongside second handle 103 rather than within second handle 103. In some embodiments, driver 122 includes a magnet 125 configured to detachably couple any number of exchangeable bits with driver 122, such as hex bit 126. In some embodiments, bit holder 121 may engage a permanent bit not intended to be removed. The ancillary tools may be coupled to second handle 103 by any number of ways known in the art, including rivets, screws, and other fasteners. As shown in FIG. 2, the ancillary tools are pivotally coupled to second handle 103 by an axle assembly having axle 120 and axle screws 124, 128. Second handle 103 may further include other components, such as clip 119, to enable ancillary tools or implement 101 to move from a stowed to deployed configuration or to secure ancillary tools or implement 101 in the stowed and deployed configurations.

In some embodiments, implement 101 is coupled to first handle 102 and second handle 103 by handle rivet 150. In some embodiments, implement 101 includes first tang 152 and second tang 153, both configured to slidably couple to first handle 102 and second handle 103, respectively. Implement 101 may further include detent button 118 and spring 117, which are both configured to, when engaged, facilitate sliding implement 101 along first and second handles 102, 103. For example, in one embodiment, implement 101 may be configured to lock into place in at least one of a deployed position, stowed position, or intermediate position, and may be further configured to be unlocked by engaging detent button 118.

Figure 3:
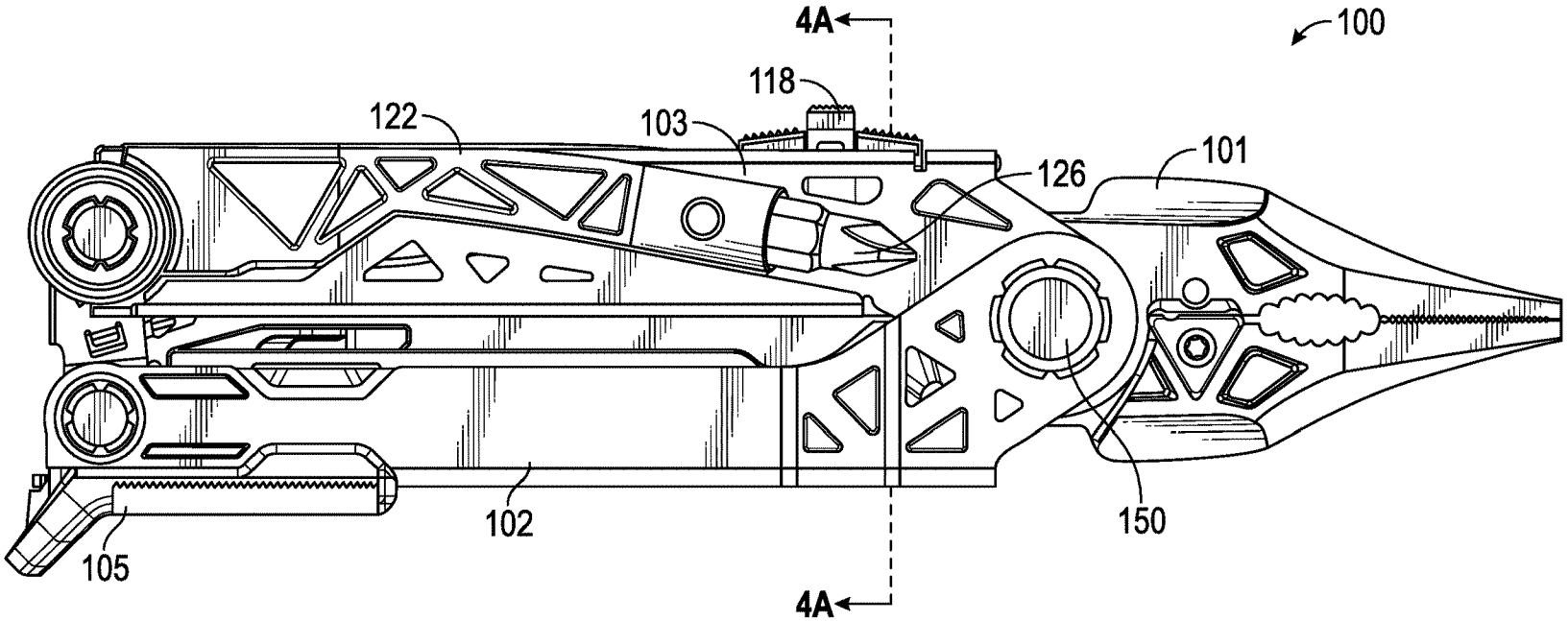
FIG. 3 is a side view of the multi-function tool of FIG. 1 where the implement is in the deployed configuration according to an exemplary embodiment.
Figure 4A:
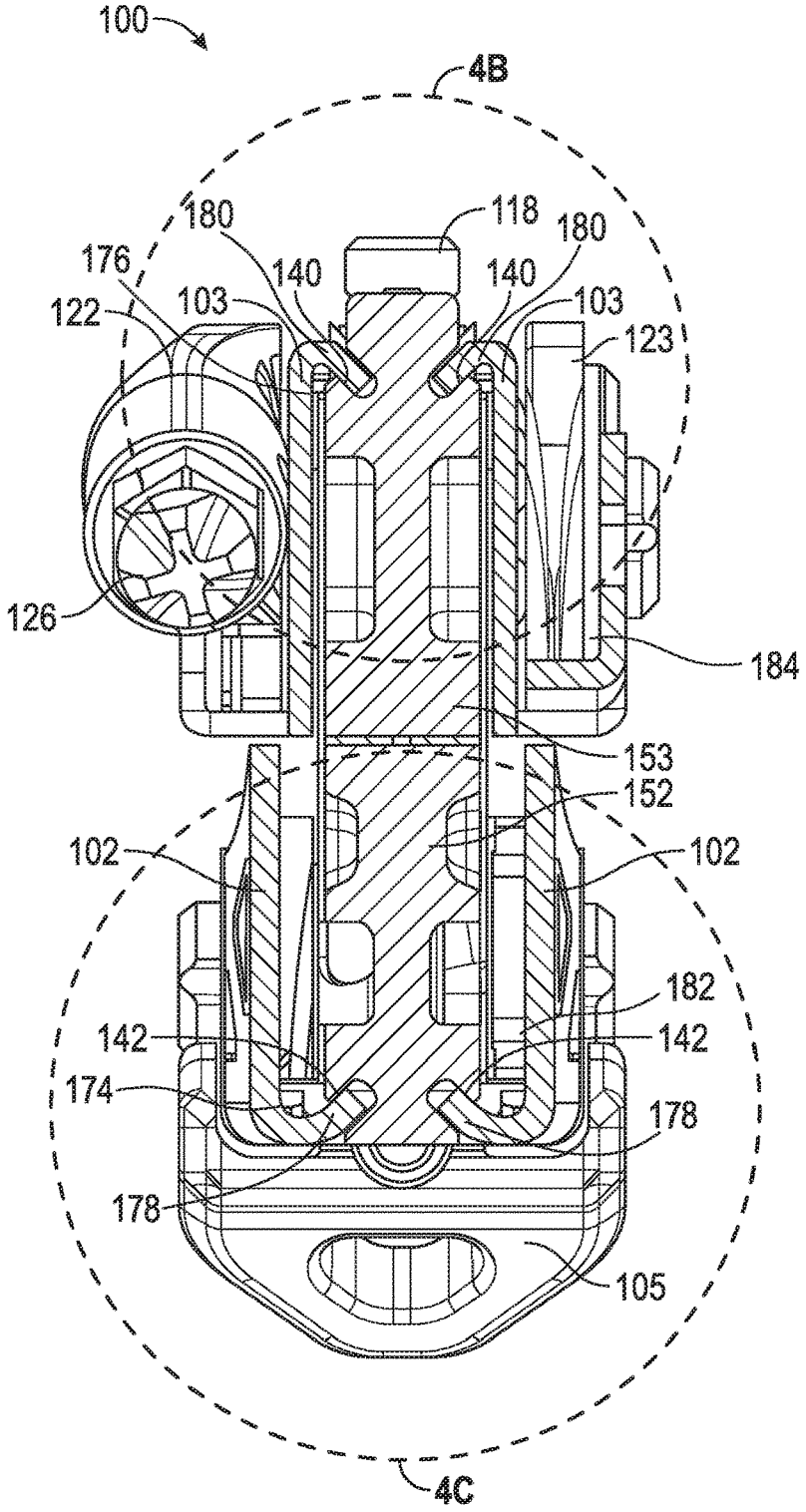
FIG. 4A is a cross-section view of the multi-function tool of FIG. 3 taken along line 4A-4A according to an exemplary embodiment.
Figure 4B:
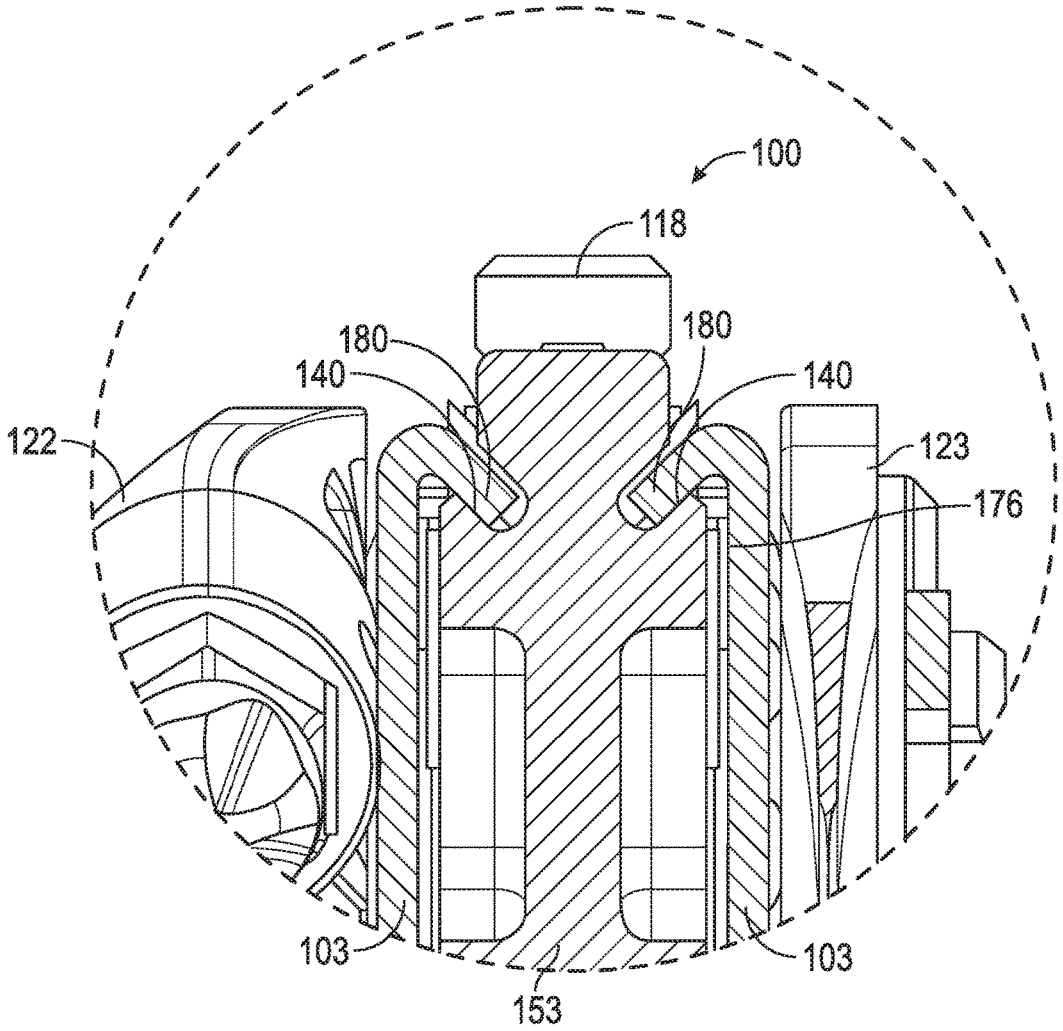
FIG. 4B is a more detailed view of section 4B of the cross-section view of the multi-function tool of FIG. 3 according to an exemplary embodiment.
Figure 4C:
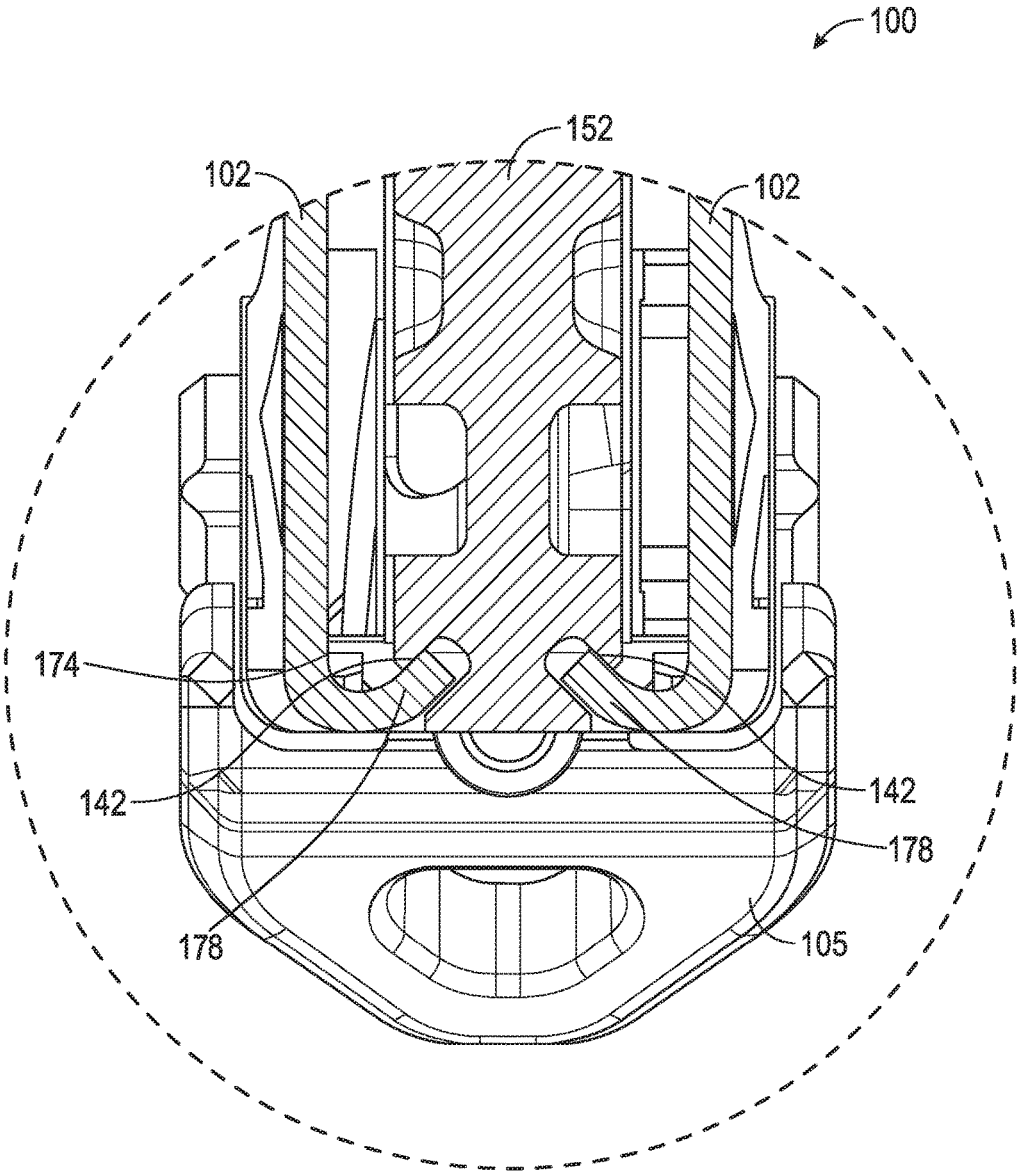
FIG. 4C is a more detailed view of section 4C of the cross-section view of the multi-function tool of FIG. 3 according to an exemplary embodiment.

Referring now to FIGS. 4A-4C, various cross-sectional views of the multi-function tool of FIG. 1 are shown according to exemplary embodiments. FIG. 4A is a cross-section view of the multi-function tool of FIG. 3 taken along line 4A-4A according to an exemplary embodiment. FIGS. 4B and 4C are more detailed sectional views of the cross-section view of the multi-function tool of FIG. 3.

As shown in FIG. 4A, implement 101 of multi-function tool 100 is slidably coupled to a wedge track in each slot 174, 176 of handles 102, 103. The wedge tracks may be configured to engage implement 101 to slidably guide implement 101 when transitioning between deployed and stowed positions. In some embodiments, the wedge tracks comprise non-linear angled tracks 178, 180 configured to interface with first tang 152 and second tang 153 of implement 101. In some embodiments, either first tang 152 or second tang 153 is configured to always be in contact with a respective non-linear angled track 178, 180 of either first handle 102 or second handle 103, for example at either one of contact points 140 or contact point 142. In some embodiments, the non-linear angled tracks 178, 180 function as a wedge against the tangs such that the tracks 178, 180 and tangs 152, 153 are always in contact, for example, at contact points 140, 142. For example, in one embodiment, spring 160 may be biased to always hold implement 101 in an open position. Spring 160 may be further configured to press tangs 152, 153 into the angled tracks 178, 180 of handles 102, 103 when implement 101 is in the stowed position or transitioning to a deployed position. As such, the angled non-linear tracks 178, 180 may be configure to function as a wedge against tangs 152, 153 to, for example, align implement 101 inside the handles and reduce audible and tactile rattling of implement 101 against handles 102, 103.

Figure 5A:
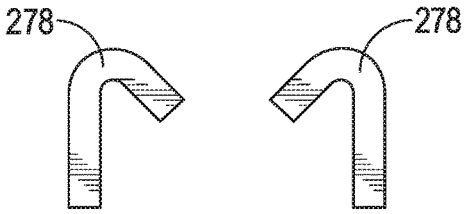
FIGS. 5A-5F are alternate wedge track profiles of the multi-function tool of FIG. 1 according to exemplary embodiments.
Figure 5B:
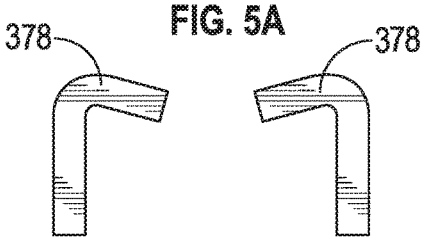
Figure 5C:
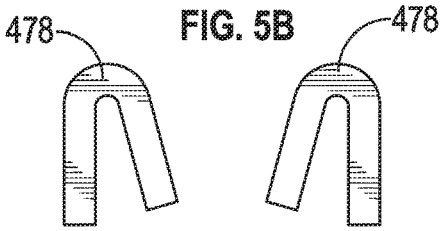
Figure 5D:
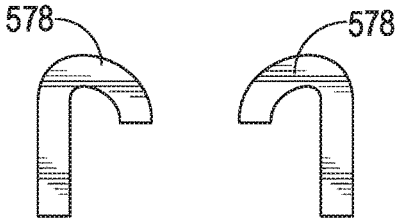
Figure 5E:
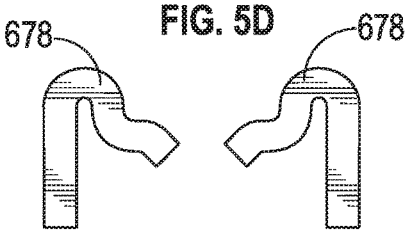
Figure 5F:
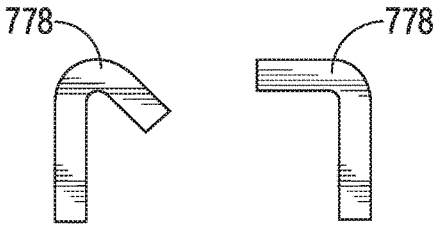

Referring now to FIGS. 5A-5F, alternate wedge track profiles of the multi-function tool of FIG. 1 are shown according to exemplary embodiments. It will be appreciated that any number of alternate wedge tracks may be used to slidably interface with implement 101. As shown in FIG. 5A, the wedge tracks 278 may comprise a 45 degree bend when viewed as a cross-section. As shown in FIG. 5B, the wedge tracks 378 may comprise a greater than 45 degree bend when viewed as a cross-section. As shown in FIG. 5C, the wedge tracks 478 may comprise a less than 45 degree bend when viewed as a cross-section. As shown in FIG. 5D, the wedge tracks 578 may comprise a rounded bend when viewed as a cross-section. As shown in FIG. 5E, the wedge tracks 678 may comprise a zig-zag shape when viewed as a cross-section. The wedge tracks of one handle may also comprise different wedge track shapes. For example, as shown in FIG. 5F, the wedge tracks 778 may include a 45 degree bend on one side while having a 90 degree bend on the other side. It will be appreciated that many combinations and alternate wedge track configurations are possible and may be chosen based on the purpose of multi-function tool 100, the specifications or characteristics of implement 101, among other factors.

Figure 6A:
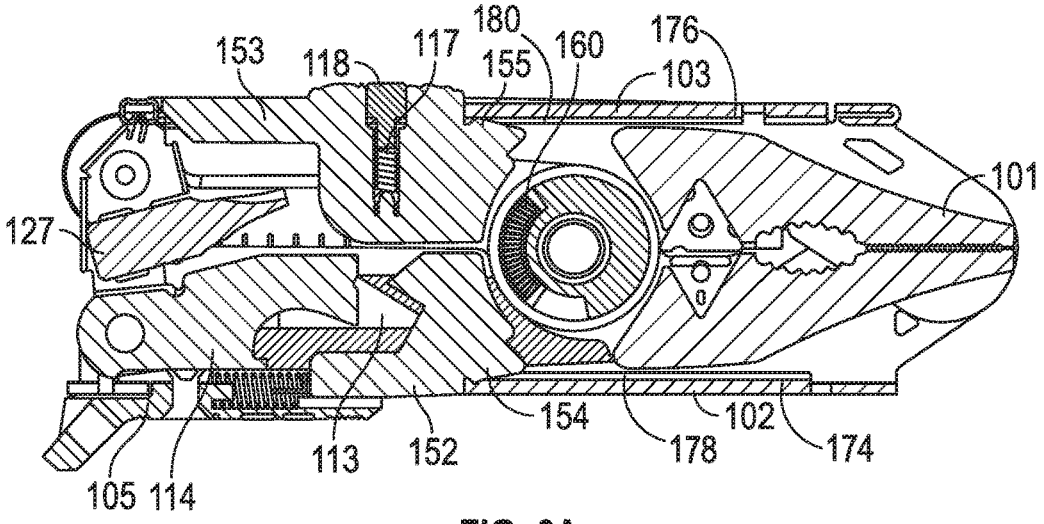
FIG. 6A is a side internal view of the multi-function tool of FIG. 1 where the implement is in a stowed configuration according to an exemplary embodiment.
Figure 6B:
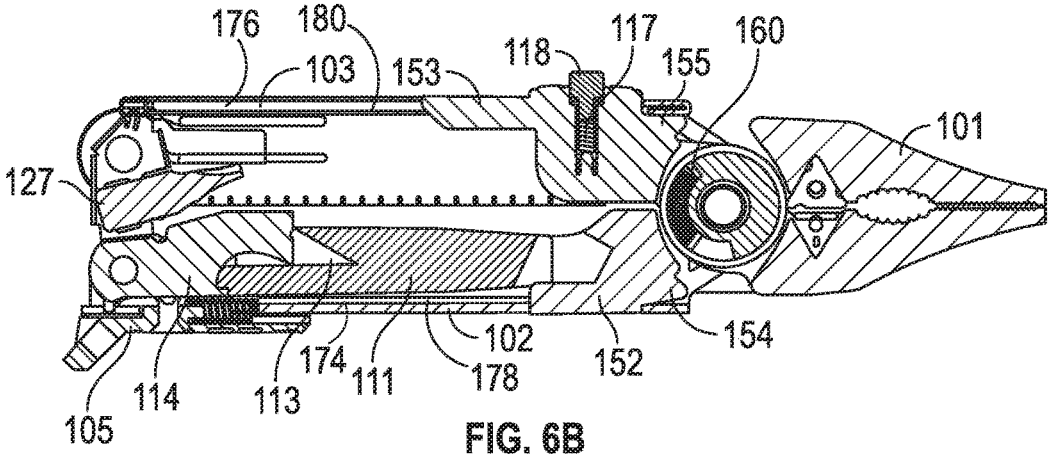
FIG. 6B is a side internal view the multi-function tool of FIG. 1 with the implement in a deployed configuration according to an exemplary embodiment.
Figure 6C:
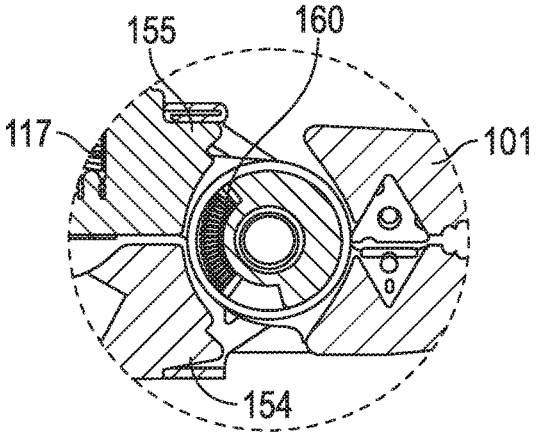
FIG. 6C is a section view of the multi-function tool of FIG. 6B where the implement is in the deployed configuration according to an exemplary embodiment.

Referring now to FIGS. 6A and 6B, side internal views of the multi-function tool of FIG. 1 are shown according to exemplary embodiments. As shown in FIG. 6A, when in a stowed configuration, implement 101 may be completely stowed within handles 102, 103. In some embodiments, implement 101 may be only partially stowed within handles 102, 103. For example, multi-function tool 100 may be configured such that a portion of implement 101 remains extended from handles 102, 103 when in the stowed position. In some embodiments, all ancillary tools, such as hex bit 127, awl 113, and prybar 114, are stowed within handles 102, 103.

In some embodiments, implement 101 includes surfaces configured to interface with an inner surface of either first handle 102 or second handle 103 as the implement is slid from a stowed position to a deployed configuration. For example, as shown in FIG. 6A, implement 101 may include a first wedge 154 to interface with an inner surface of first handle 102 and second wedge 155 to interface with an inner surface of second handle 103. As shown in FIG. 6B, and in more detail in FIG. 6C, as implement 101 is slid from a stowed position to a deployed position, wedges 154, 155 interface with handles 102, 103, respectively, thereby creating interference between the implement 101 and handles 102, 103 to push the implement 101 closed such that the working portions of each member of implement 101 are held together when the implement 101 is fully deployed. As such, the implement may be tightly closed when fully deployed, thereby enabling the implement to close on very thin items (e.g., a sheet of paper, a thread, etc.).

In some embodiments, implement 101 is configured to have a loose up-down tolerance with handles 102, 103 through most of the transition of the implement 101 from a stowed position to a deployed position. In some embodiments, the wedges 154, 155 do not interface with surfaces of the handles 102, 103 until the implement 101 is either fully deployed or substantially fully deployed. In some embodiments, the wedges 154, 155 interface with surfaces of the handles 102, 103 starting mid stroke. In some embodiments, the interference between wedges 154, 155 and handles 102, 103 increases as implement 101 is deployed resulting in a maximum interference once implement 101 is fully deployed. In some embodiments, a maximum interference is reached before implement 101 is fully deployed. In some embodiments, tangs 152, 153 maintain contact with respective surfaces of handles 102, 103 throughout the entire stroke of implement 101 from a stowed position to a deployed position. In some embodiments, wedges 154, 155 of tangs 152, 153 maintain contact with respective surfaces of handles 102, 103 through the entire stroke of implement 101.

In some embodiments, multi-function tool 100 may further include a detent button 118 and spring 117 configured to be engaged by a user of multi-function tool 100 to release implement 101 from a locked position so that implement 101 may slide from a stowed to deployed position or from a deployed to a stowed position. In some embodiments, the detent button 118 may be biased into a locked position along detents provided within the frame of the first and second handles 102, 103. As such, implement 101 may be selectively locked or slid along the handles 102, 103. In some embodiments, implement 101 includes a locking member that interacts with detents such that detent button 118 must be engaged to unlock implement 101 from the frame of at least one of the first and second handles 102, 103.

Figure 7A:
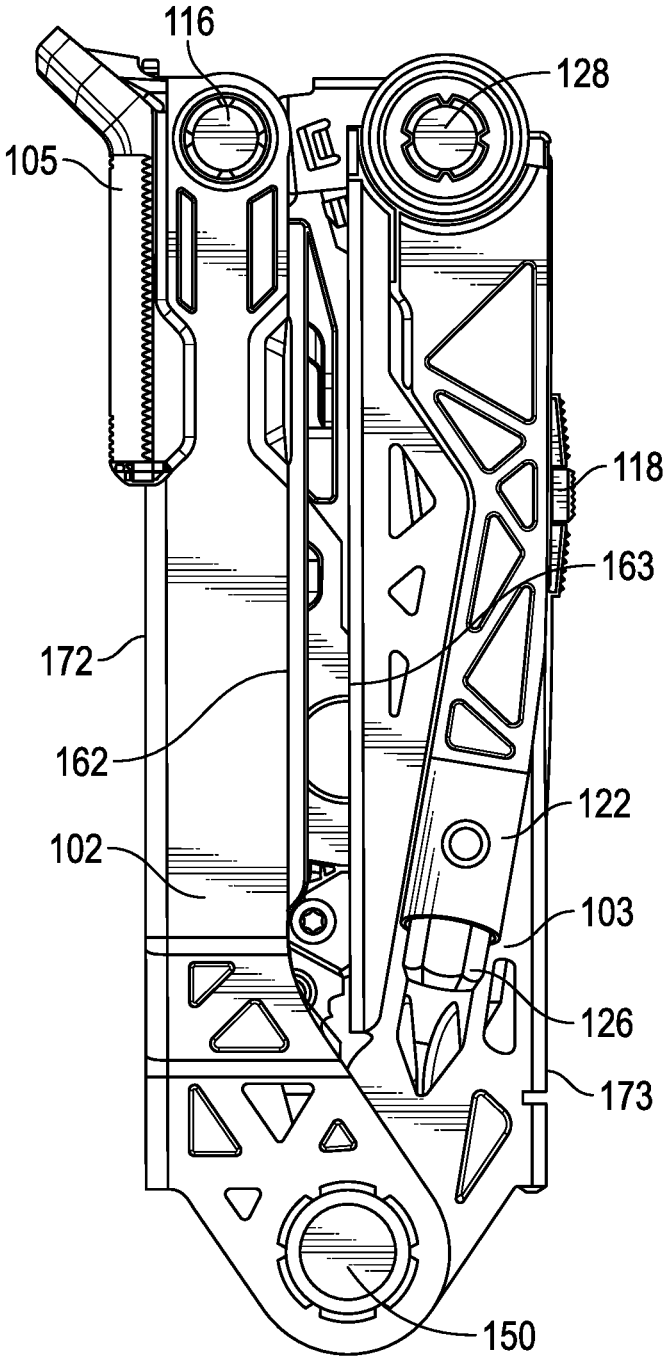
FIG. 7A is a side view of the multi-function tool of FIG. 1 having a driver in a stowed configuration according to an exemplary embodiment.
Figure 7B:
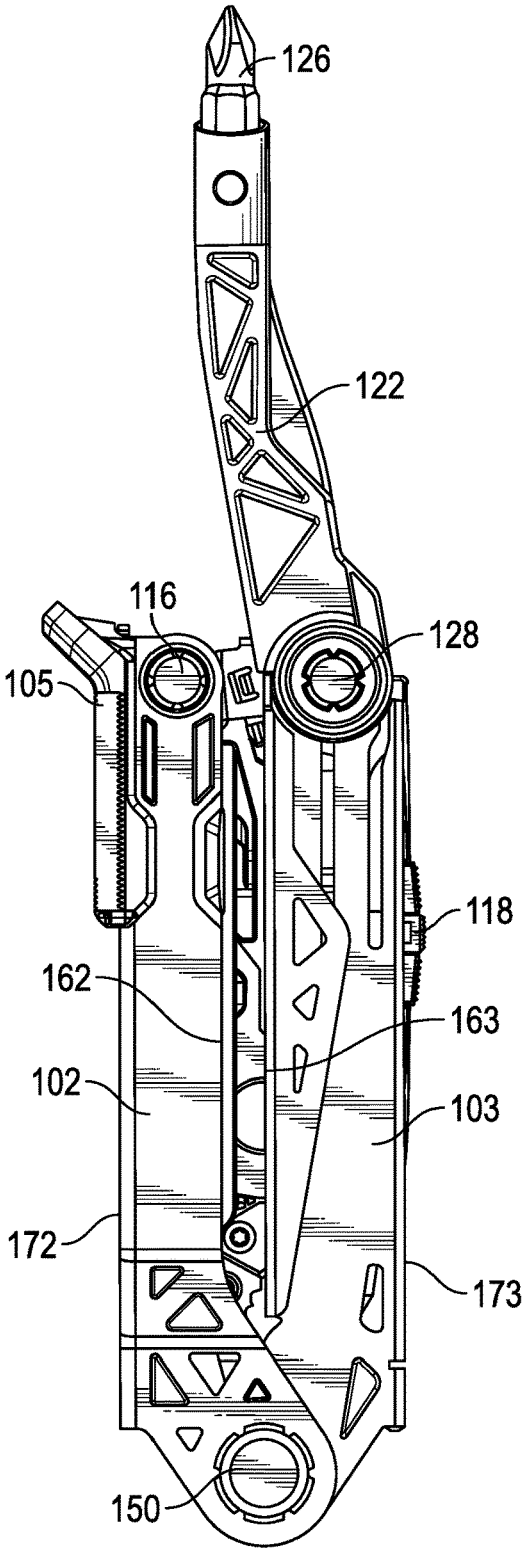
FIG. 7B is a side view of the multi-function tool of FIG. 1 where the driver is in a deployed configuration according to exemplary embodiment.

Referring now to FIGS. 7A-7B, side views of multi-function tool 100 having driver 122 in a stowed configuration and a deployed configuration are shown according to exemplary embodiments. Multi-function tool 100 and driver 122 may be configured such that driver 122 has a stowed configuration and a deployed configuration. As shown in FIG. 7A, driver 122 is stowed alongside second handle 103 of multi-function tool 100. In some embodiments, driver 122 may be configured to be stowed within at least one handle of multi-function tool 100, such as second handle 103. In some embodiments, driver 122 may be substantially stowed within, or at least partially stowed within second handle 103. Driver 122 may be configured to transition to a deployed configuration by any number of ways known in the art, including sliding, snapping, folding, twisting, pivoting, swinging, and so on.

Particularly referring to FIG. 7B, in one embodiment, driver 122 is configured to swing about an axle assembly having axle screw 128. While FIG. 7B shows driver 122 swinging about an axle assembly located at one end of second handle 103 of multi-function tool 100, it will be appreciated that driver 122 may be coupled to any portion of multi-function tool 100. As shown in FIG. 7B, bit 126 of driver 122 has an on-center position relative to the combined mass of first and second handles 102, 103 when driver 122 is fully deployed. In some embodiments, driver 122 may be curved, include a curved portion, or extend at an angle from second handle 103.

In some embodiments, the shape of driver 122 is configured such that bit 126 of driver 122 has an on-center position relative to handles 102, 103 when driver 122 is pivoted one-hundred-eighty degrees from the stowed position to the deployed position. In some embodiments, driver 122 pivots less than 180 or greater than 180 degrees from the stowed position to the deployed position to have an on-center position relative to handles 102, 103. In some embodiments, bit 126 of driver 122 is configured to have an on-center position relative to the combined mass of first and second handles 102, 103. In some embodiments, bit 126 of driver 122 is configured to have an on-center position relative to the width of multi-function tool 100 or a combined width of first and second handles 102, 103 without regard to the combined mass of first and second handles 102, 103.

In some embodiments, a working axis of driver 122 has an on-center position relative to components of multi-function tool 100 when driver 122 is in the deployed position. The working axis of driver 122 may be defined by a center axis of bit 126 or a center axis extending along at least a portion of driver 122. When the working axis of driver 122 is on-center relative to components of multi-function tool 100, the working axis may overlay, align with, or intersect a point on or adjacent to a component of driver 100, a midpoint between components of driver 100, or be parallel to a surface of driver 100. The working axis of driver 122 may be on-center relative to first handle 102 and second handle 103. The working axis of driver 122 may be on-center relative to portions of first handle 102 and second handle 103, such as inner surface 162 and an outer surface 172 of first handle 102, and inner surface 163 and an outer surface 173 of second handle 103.

In some embodiments, the working axis of driver 122 has an on-center position relative to outer surfaces 172, 173. In some embodiments, the working axis of driver 122 has an on-center position relative to inner surfaces 162, 163. For example, in one embodiment, the working axis of driver 122 aligns with a midpoint between inner surface 162 and inner surface 163. In another example, the working axis of driver 122 substantially aligns with a midpoint between inner surface 162 and inner surface 163. In another example, the working axis of driver 122 is an on-center position parallel to and offset from a midpoint between inner surface 162 and inner surface 163 (e.g., offset by less than 0.01 inches, less than 0.015 inches, less than 0.025 inches). In some embodiments, the working axis of driver 122 has an on-center position relative to rivet 150. In some embodiments, the working axis of driver 122 has an on-center position relative to axle screw 116 and axle screw 128. Locating the driver 122 and or the bit 126 in one of the on-center positions described above results in a bit driver that is easier for an operator to use than conventional bit drivers found in conventional multi-function tools where the bit driver may be centered relative to a single handle rather than the entire tool. Locating the driver 122 and or the bit 126 in one of the on-center positions described above makes the bit driver easier for the operator to twist and apply torque to a fastener with the multi-function tool 100 than conventional multi-function tools, in which the bit driver centered relative to a single handle may be difficult or uncomfortable for an operator to use because the axis of the bit driver is substantially offset from the axis at which the operator twists the entire multi-function tool.

Figure 7C:
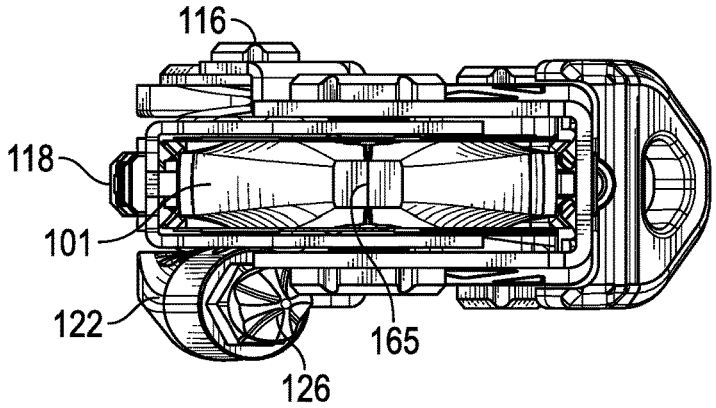
FIG. 7C is a front view of the multi-function tool of FIG. 1 where the driver is in a stowed configuration according to exemplary embodiment.
Figure 7D:
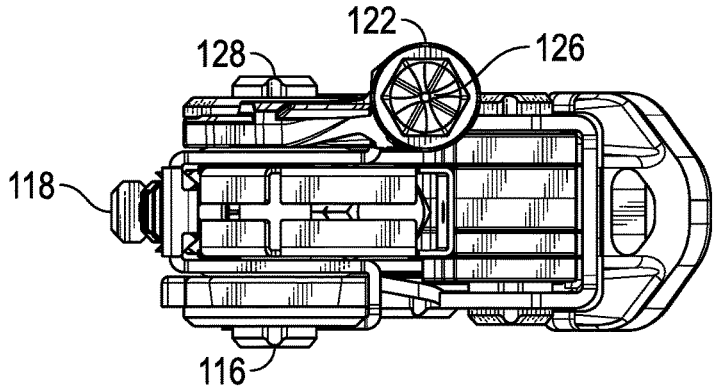
FIG. 7D is a rear view of the multi-function tool of FIG. 1 where the driver is in a deployed configuration according to exemplary embodiment.
Figure 7E:
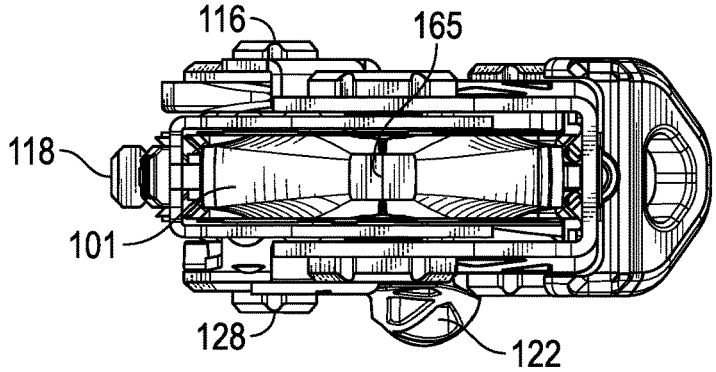
FIG. 7E is a front view of the multi-function tool of FIG. 1 where the driver is in a deployed configuration according to exemplary embodiment.

Referring now to FIGS. 7C-7E, front and rear views of multi-function tool 100 having driver 122 in stowed and deployed configurations are shown according to exemplary embodiments. As shown in FIGS. 7C and 7E, implement 101 includes an interface point 165 where the jaws of implement 101 interface with one another when implement 101 is in a closed position (e.g., when first handle 102 and second handle 103 are squeezed together). In some embodiments, the working axis of driver 122 has an on-center position relative to interface point 165 of implement 101.

Figure 7F:
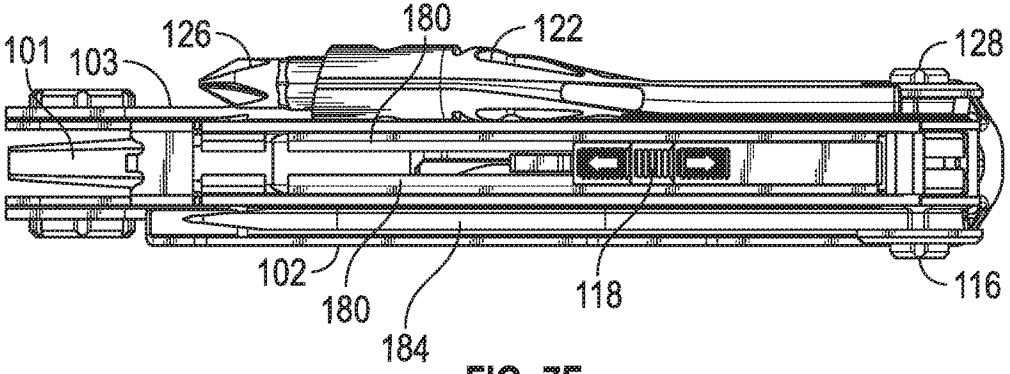
FIG. 7F is a top view of the multi-function tool of FIG. 1 where the driver is in a stowed configuration according to exemplary embodiment.
Figure 7G:
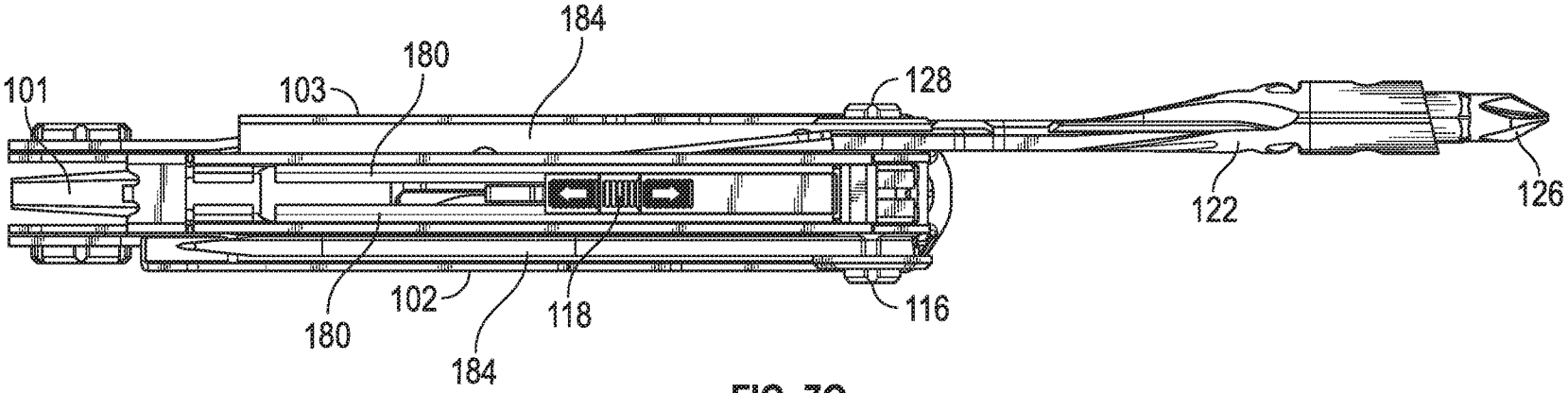
FIG. 7G is a top view of the multi-function tool of FIG. 1 where the driver is in a deployed configuration according to exemplary embodiment.

Referring now to FIGS. 7F-7G, top views of multi-function tool 100 having driver 122 in a stowed configuration and a deployed configuration are shown according to exemplary embodiments. While driver 122 is shown as being housed alongside second handle 103, it will be appreciated that driver 122 may be housed alongside first handle 102, or housed within either first handle 102 or second handle 103.

Figure 8:
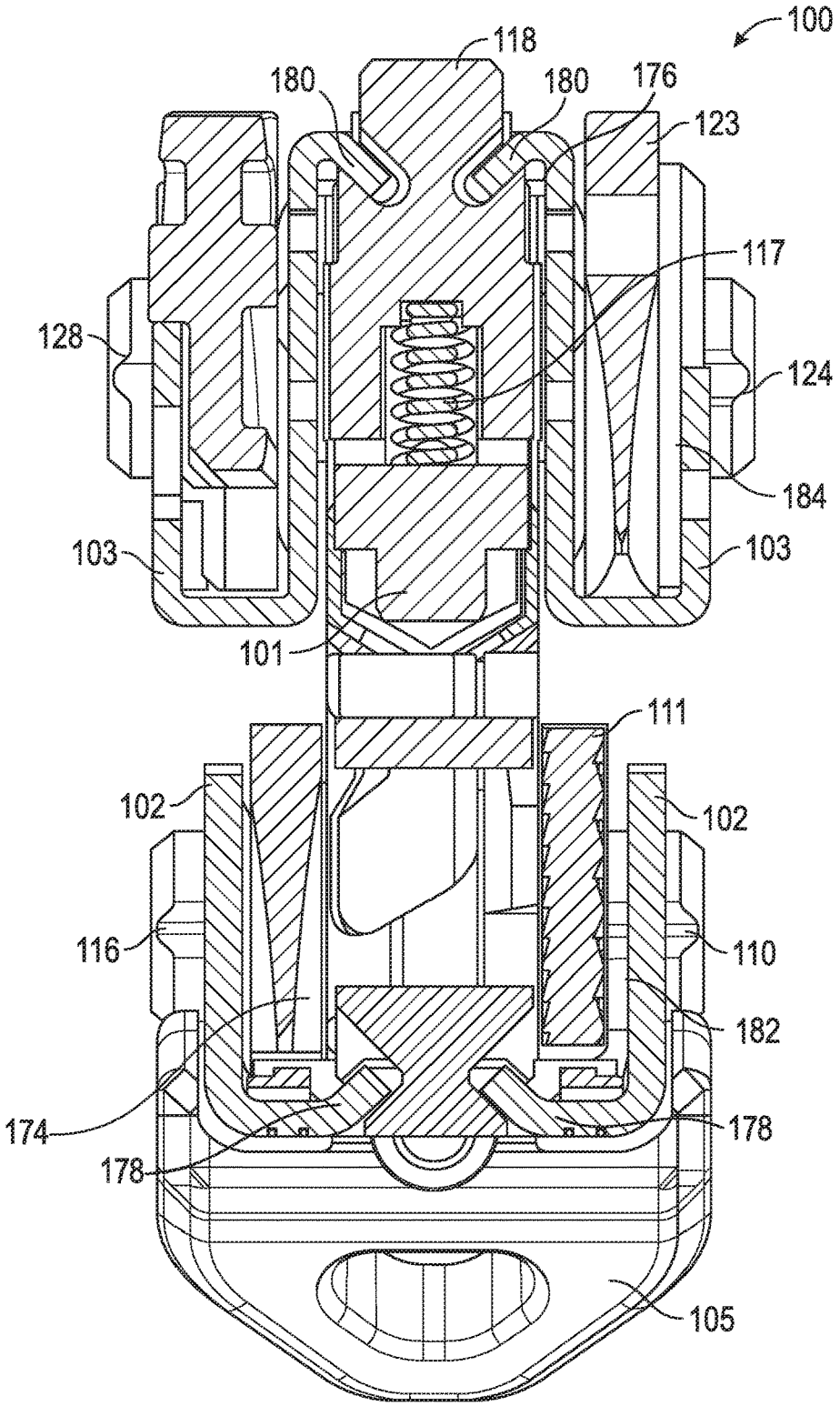
FIG. 8 is a cross-section view of a multi-function tool having handles with different profile shapes according to an exemplary embodiment.

Referring now to FIG. 8, a cross-section view of multi-function tool 100 having handles with different profile shapes is shown according to an exemplary embodiment. As shown in FIG. 8, multi-function tool 100 includes first handle 102 and second handle 103. In some embodiments, first handle 102 may have a channel 182 that is generally U-shaped when viewed as cross-section profile and second handle 103 may have a channel 184 that is generally W-shaped when viewed as a cross-section profile. It will be appreciated that other handle shapes are contemplated and may be used for both first and second handles 102, 103 or used in combination with another handle channel shape (e.g., an S-shaped handle channel, etc.).

As shown in FIG. 8, the U-shaped channel 182 of first handle 102 stores components, such as ancillary tools, more compactly than the W-shaped channel 184 of second handle 103. In some embodiments, however, the U-shaped channel 182 of first handle 102 requires a user to use two hands to deploy components stored within first handle 102, such as file 111. For example, in some embodiments, a user may be required to hold first handle 102 with one hand and to deploy file 111 with the other hand. The U-shaped channel 182 of first handle 102 may further require multiple mechanical steps before deploying a component stored within. For example, in some embodiments, components may be deployed from an inner surface of first handle 102, thereby causing second handle 103 to impede a user from deploying a component stowed within first handle 102 (e.g., when first and second handles 102, 103 are held together, when implement 101 occupies a stowed position, etc.). Accordingly, in some embodiments, a user may be required to pull first and second handles 102, 103 apart or to deploy implement 101 before being able to deploy a component stowed in the U-shaped channel 182 of first handle 102.

As shown in FIG. 8, the W-shaped channel 184 of second handle 103 may not store components, such as ancillary tools, as compactly than the U-shaped channel of first handle 102. In some embodiments, however, the W-shaped channel 184 of second handle 103 enables a user to use a single hand to deploy components stored within second handle 103, such as blade 123. For example, in some embodiments, a user may be able to hold second handle 103 with one hand and to deploy blade 123 with a finger of the same hand without requiring other intervening steps or the assistance of an additional hand. The W-shaped channel 184 of second handle 103 also typically does not require multiple mechanical steps before deploying a component stored within second handle 103. For example, in some embodiments, such as the embodiment shown in FIG. 8, the W-shaped channel 184 of second handle 103 enables components stored within to be exposed and manipulated from an external surface of multi-function tool 100 while protecting implement 101. As such, the first and second handles 102, 103 of multi-function tool 100 do not need to be pulled apart nor does implement 101 need to be deployed before a blade 123 is deployed.

It will be appreciated that the multi-function tool 100 may have handles having the same channel shape or handles having different channel shapes. In some embodiments, the handle shapes chosen for multi-function tool 100 may depend on the use of multi-function tool 100 or a user's preference. For example, a user that wishes to quickly access ancillary tools or that needs to deploy ancillary tools using only one hand may prefer a multi-function tool 100 having W-shaped channels for both first and second handles 102, 103. A user that wishes to have a multi-function tool 100 that stores ancillary tools very compactly (i.e., for a smaller overall multi-function tool or a multi-function tool including additional tools) may prefer a multi-function tool 100 having U-shaped channels for both first and second handles 102, 103. Some users may wish to enjoy the benefits that both U-shaped and W-shaped channels offer and may accordingly prefer a multi-function tool in which first handle 102 has a U-shaped channel and second handle 103 has a W-shaped channel.

In some embodiments, primary ancillary tools that are used more often (e.g., blade 123, driver 122, etc.) may be stowed within a handle having a W-shaped channel while secondary ancillary tools (e.g., awl 113, prybar 114, file 111, etc.) may be stowed within a handle having a U-shaped channel. Such a configuration may provide a user with quick one-handed access to ancillary tools that the user is more likely to use while a greater number of ancillary tools are stowed in another handle having a more compact W-shaped channel. It will be appreciated that various configurations of handle shape and arrangement of tools within various handle shapes are possible such that the advantages of a particular channel shape may be maximized while the disadvantages of a particular channel shape are minimized based on, for example, a user's preference or purpose of the particular multi-function tool.

It is important to note that the construction and arrangement of the multi-function tool as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. While the detailed drawings, specific examples, and particular formulations given describe certain exemplary embodiments, they serve the purpose as illustration only. The invention is not limited to the specific forms shown. The configuration of multi-function tool may differ depending on chosen performance characteristics and physical characteristics of the components of the multi-function tool. For example, the implement may take a variety of configurations and perform different functions depending on the needs of the user. Furthermore, other substitutions, modifications, changes, and omissions may be made in the design, operating conditions, and arrangement of the exemplary embodiments without departing from the scope of the invention as expressed in the appended claims. Elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A multifunction tool, comprising:

a first handle and a second handle, wherein each of the first and second handles comprise two tracks spaced apart from and opposing one another, one of the tracks including a straight section and an angled section, the angled section extending obliquely away from the straight section toward the opposing track, the two tracks together defining a non-linear track and forming a slot positioned between the two tracks; and a jaw assembly slidably coupled to the non-linear tracks of the first and second handles, wherein the jaw assembly is configured to slide within the slots of the first and second handles between a stowed position within the handles and a deployed position extending from the handles.

2. The multi-function tool of claim 1, wherein the angled section of the non-linear track of the first and second handles each define an angled track configured to function as a wedge against the jaw assembly as the jaw assembly slides from the stowed position to the deployed position.

3. The multi-function tool of claim 2, wherein the angled track of the first handle and the angled track of the second handle each have a track profile of less than fifty degrees.

4. The multi-function tool of claim 3, wherein the angled track of the first handle and the angled track of the second handle each have a track profile of forty-five degrees.

5. The multi-function tool of claim 1, wherein the jaw assembly comprises a pair of jaws pivotally coupled together, each of the jaws comprising a tang, wherein the tangs are configured to slidably engage the non-linear tracks of the first and second handles, and wherein each tang is configured to always be in contact with the track of one of the first and second handles while in each of the stowed position, the deployed position, and during a transition from the stowed position to the deployed position.

6. The multi-function tool of claim 1, further comprising a plurality of tools, each tool having a stowed position and a deployed position, wherein the first handle comprises a first channel having a first shape partially defined by the straight section of the non-linear track of the first handle, and wherein the second handle comprises a second channel having a second shape partially defined by the straight section of the non-linear track of the second handle.

7. The multi-function tool of claim 6, wherein the first shape is positioned within the slot of the first handle and configured to compactly store a tool of the plurality of tools configured to be deployed using two hands.

8. The multi-function tool of claim 7, wherein the second shape is positioned outside the slot of the second handle and configured to store a tool of the plurality of tools less compactly than the first handle and configured to be deployed using only one hand.

9. The multi-function tool of claim 8, wherein the first channel of the first handle is U-shaped and the second channel of the second handle is W-shaped.

10. The multi-function tool of claim 1, further comprising:

a driver having a stowed position and a deployed position;

wherein with the two handles in the closed position and the driver in the deployed position, the driver is in an on-center position relative to the two handles; and wherein with the two handles in the closed position and the driver in the stowed position, the driver is not in an on-center position relative to the two handles.

11. The multi-function tool of claim 10, wherein the driver is pivotally coupled to the first handle and configured to pivot between the stowed position either within or alongside the first handle and the deployed position extending from the first handle.

12. The multi-function tool of claim 11, wherein the driver further comprises a shaft and a bit, and wherein the shaft is curved such that when the driver is in the deployed position, the bit has an on-center position relative to at least one of a combined mass of the first and second handles, a midpoint between an inner surface of the first handle and an inner surface of the second handle, a midpoint between an outer surface of the first handle and an outer surface of the second handle, and an axis defined by an interface point where a first implement of the jaw assembly interfaces with a second implement of the jaw assembly.

13. The multi-function tool of claim 1, wherein the first handle and the second handle each have an inner surface and an outer surface, the multi-function tool further comprising:

a jaw assembly comprising a pair of jaws pivotally coupled together, each of the jaws comprising a tang having a wedge configured to interface with the inner surface of either the first or second handle to create an interference that pushes the jaws closed when the jaw assembly is slid from a stowed position to a deployed position.

14. A multi-function tool, comprising:

a first handle and a second handle pivotable between an open position and a closed position;

a jaw assembly slidably coupled to the first and second handles, wherein the jaw assembly is configured to move between a stowed position within the handles and a deployed position extending from the handles; and a driver pivotally coupled to the first handle and configured to pivot between a stowed position alongside the first handle and a deployed position extending from the first handle;

wherein with the two handles in the closed position and the driver in the deployed position, the driver is in an on-center position relative to the two handles; and wherein with the two handles in the closed position and the driver in the stowed position, the driver is not in an on-center position relative to the two handles.

15. The multi-function tool of claim 14, wherein the driver further comprises a shaft and a bit, and wherein the shaft is curved such that when the driver is in the deployed position, the bit has an on-center position relative to a combined mass of the first and second handles.

16. The multi-function tool of claim 14, wherein the driver further comprises a shaft and a bit, and wherein the shaft is curved such that when the driver is in the deployed position, the bit has an on-center position relative to a midpoint between an inner surface of the first handle and an inner surface of the second handle.

17. The multi-function tool of claim 14, wherein the driver further comprises a shaft and a bit, and wherein the shaft is curved such that when the driver is in the deployed position, the bit has an on-center position relative to a midpoint between an outer surface of the first handle and an outer surface of the second handle.

18. The multi-function tool of claim 14, wherein the driver further comprises a shaft and a bit, and wherein the shaft is curved such that when the driver is in the deployed position, the bit has an on-center position relative to an axis defined by an interface point where a first implement of the jaw assembly interfaces with a second implement of the jaw assembly.

19. The multi-function tool of claim 14, wherein the driver further comprises a curved shaft and a bit, the bit being detachably and magnetically coupled an end of the curved shaft.

20. A multi-function tool, comprising:

a plurality of tools, each tool having a stowed position and a deployed position;

a first handle comprising two tracks spaced apart from and opposing one another, one of the tracks including a straight section and an angled section, the angled section extending obliquely away from the straight section toward the opposing track, the two tracks together defining a non-linear track and forming a slot positioned between the two tracks, the non-linear track partially defining a first channel within the non-linear track having a first shape configured to compactly store a tool of the plurality of tools configured to be deployed using two hands;

a second handle comprising two tracks spaced apart from and opposing one another, one of the tracks including a straight section and an angled section extending away from the straight section toward the opposing track, the two tracks together defining a non-linear track and a slot formed between the non-linear track, the straight section partially defining a second channel outside the slot and having a second shape configured to store a tool of the plurality of tools less compactly than the first handle and configured to be deployed using only one hand;

a jaw assembly slidably coupled to the non-linear tracks of the first and second handles, wherein the jaw assembly is configured to slide within slots of the first and second handles between a stowed position within the handles and a deployed position extending from the handles, wherein the jaw assembly comprises a pair of jaws pivotally coupled together, each of the jaws comprising a tang having a wedge configured to interface with an inner surface of either the first or second handle to cause an interference that pushes the jaws closed when the jaw assembly is slid from a stowed position to a deployed position; and a driver having a stowed position and a deployed position;

wherein with the two handles in the closed position and the driver in the deployed position, the driver is in an on-center position relative to the two handles; and wherein with the two handles in the closed position and the driver in the stowed position, the driver is not in an on-center position relative to the two handles;

wherein the driver is pivotally coupled to the first handle and configured to pivot between the stowed position either within or alongside the first handle and the deployed position extending from the first handle; and wherein the driver further comprises a shaft and a bit, and wherein the shaft is curved such that when the driver is in the deployed position, the bit has an on-center position relative to at least one of a combined mass of the first and second handles, a midpoint between an inner surface of the first handle and an inner surface of the second handle, a midpoint between an outer surface of the first handle and an outer surface of the second handle, and an axis defined by an interface point where a first implement of the jaw assembly interfaces with a second implement of the jaw assembly.

* * * * *